US005813900A

United States Patent [19]

Wyatt

[11] Patent Number: 5,813,900

[45] Date of Patent: Sep. 29, 1998

[54] GRINDING MACHINE FOR GRINDING CYLINDRICAL WORKPIECES

[75] Inventor: Colin Wyatt, Dunchurch, England

[73] Assignee: T&N Technology Ltd., Rugby, England

[21] Appl. No.: 793,054

[22] PCT Filed: Sep. 12, 1995

[86] PCT No.: PCT/GB95/02241

§ 371 Date: Feb. 14, 1997

§ 102(e) Date: Feb. 14, 1997

[87] PCT Pub. No.: WO96/09137

PCT Pub. Date: Mar. 28, 1996

[30] Foreign Application Priority Data

Sep. 20, 1994 [GB] United Kingdom ..... 9418923

[51] Int. Cl.[6] ..... B24B 49/00; B24B 51/00

[52] U.S. Cl. ..... 451/10; 451/62; 451/228; 451/252

[58] Field of Search ..... 451/28, 5, 8, 9, 451/10, 11, 13, 23, 24, 49, 51, 251, 252, 138, 216, 228, 62

[56] References Cited

U.S. PATENT DOCUMENTS

| | | | |
|---|---|---|---|
| 2,247,228 | 6/1941 | Flygare | 451/216 |
| 4,468,892 | 9/1984 | Giebmanns | 451/11 |
| 4,527,356 | 7/1985 | Ozone et al. | 51/101 R |
| 4,885,874 | 12/1989 | Wedeniwski | 51/165.77 |
| 4,928,437 | 5/1990 | Waelti | 51/165.71 |
| 5,027,562 | 7/1991 | Kobayashi et al. | 451/11 |
| 5,697,831 | 12/1997 | Reichel | 451/251 |

FOREIGN PATENT DOCUMENTS

| | | | |
|---|---|---|---|
| 0 261 510 | 3/1988 | European Pat. Off. . | |
| 2 352 635 | 12/1977 | France | B24B 17/00 |
| 3 335 929 | 4/1985 | Germany | B24B 19/12 |
| 2 053 752 | 2/1981 | United Kingdom | B24B 19/12 |
| 2 237 225 | 5/1991 | United Kingdom | B23Q 19/12 |
| 2 265 324 | 9/1993 | United Kingdom | B23Q 15/007 |

*Primary Examiner*—Timothy V. Eley
*Assistant Examiner*—Derris H. Banks
*Attorney, Agent, or Firm*—Synnestvedt & Lechner

[57] ABSTRACT

A grinding machine includes a rotating grinding wheel and workpiece moving apparatus operable to move a workpiece towards and away from the wheel. The apparatus is arranged to move a workpiece support arcuately about an axis to move a workpiece towards or away from the wheel. A motor turns the workpiece to present different parts of the workpiece to the wheel, and an orientation detector signals the orientation of the workpiece so that the operations of the workpiece moving apparatus, and the motor can be coordinated to cause a desired profile to be ground on the workpiece. The machine also comprises correcting apparatus operable in response to the operation of the workpiece moving apparatus to cause the output of the orientation detector to be altered to compensate for angular alterations in the point of contact of the workpiece with the grinding wheel caused by the arcuate movement of the workpiece support.

6 Claims, 1 Drawing Sheet

GRINDING MACHINE FOR GRINDING CYLINDRICAL WORKPIECES

Figure 2:
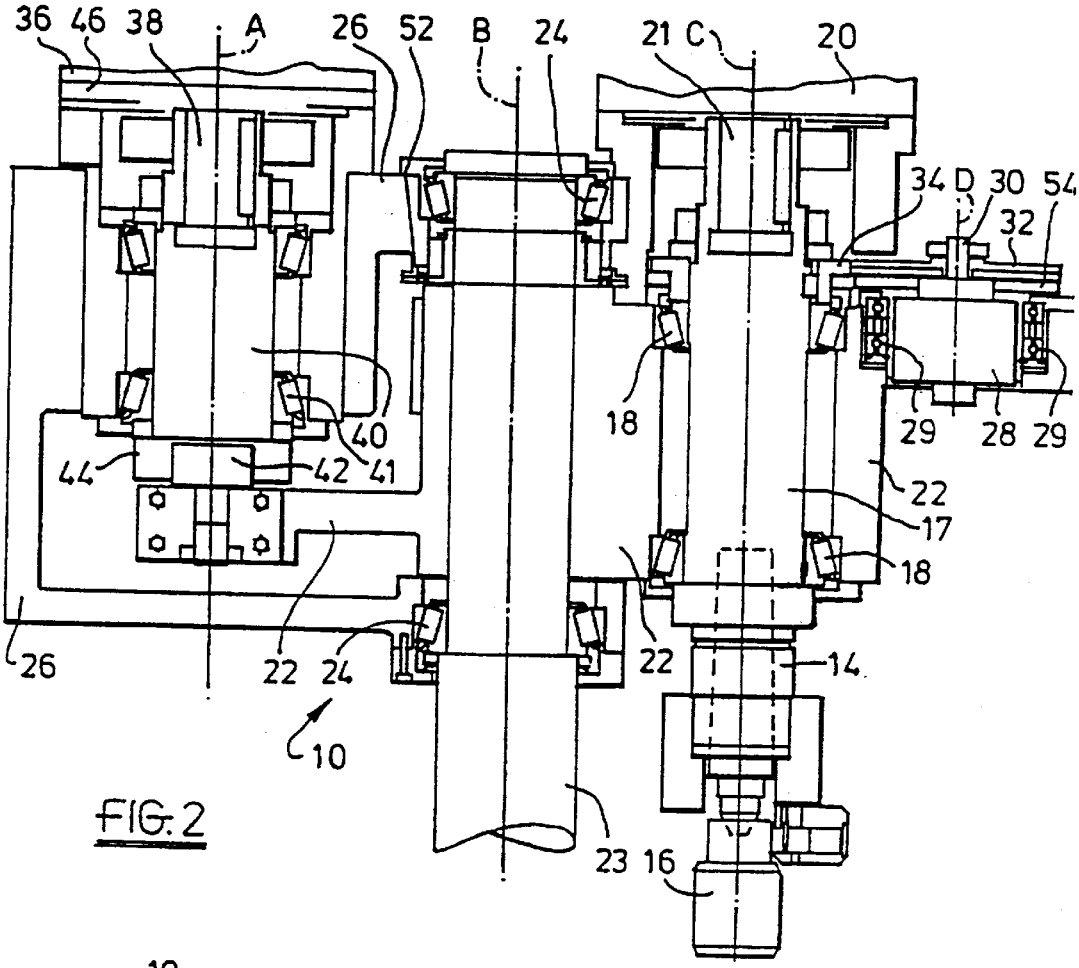

This invention is concerned with a grinding machine for use in grinding workpieces to a desired shape. Such a grinding machine may be used, for example, in grinding a cast cam blank to its final shape.

One known grinding machine comprises a grinding wheel having an abrasive circumferential surface arranged to remove material from a workpiece when the grinding wheel is applied thereto, rotating means operable to rotate the grinding wheel about a central axis thereof, a workpiece support arranged to support a workpiece so that the workpiece can turn about an axis of the support, turning means operable to turn a workpiece on said support about the axis of the support to present different parts of the surface of the workpiece to the grinding wheel, orientation detecting means operable to detect the orientation of the workpiece on the support, moving means operable to bring about relative movement between the workpiece support and the grinding wheel, and control means operable to control the operations of the turning means and of the moving means in accordance with signals received from the orientation detecting means so that the workpiece is ground to a desired shape.

The moving means may be arranged to move the workpiece support arcuately about an axis of the machine to bring about said relative movement. Said axis of the machine is parallel to the axis of the grinding wheel and off-set therefrom. This type of moving means is relatively simple and the workpiece support can be positioned with considerable accuracy. However, the use of such a moving means can lead to inaccuracies in the shape ground because the arcuate movement of the workpiece support alters the point of contact of the workpiece on the grinding wheel relative to what it would be if the movement were linear. Thus, there is a discrepancy between the output of the orientation detecting means and the position on the workpiece on which the grinding wheel is acting. This discrepancy can be taken into account by requiring the control means to calculate a correction but either a complex and expensive control means has to be provided or productivity is lost due to slower grinding to allow time for the calculations to be made.

It is an object of the present invention to provide a grinding machine in which the aforementioned discrepancy is taken into account without requiring calculations by the control means of the machine.

The invention provides a grinding machine comprising a grinding wheel having an abrasive circumferential surface arranged to remove material from a workpiece when the grinding wheel is applied thereto, rotating means operable to rotate the grinding wheel about a central axis thereof, a workpiece support arranged to support a workpiece so that the workpiece can turn about an axis of the support, turning means operable to turn a workpiece on said support about the axis of the support to present different parts of the surface of the workpiece to the grinding wheel, orientation detecting means operable to detect the orientation of the workpiece on the support, moving means operable to bring about relative movement between the workpiece support and the grinding wheel, the moving means being arranged to move the workpiece support arcuately about an axis of the machine to bring about said relative movement, and control means operable to control the operations of the turning means and of the moving means, in accordance with signals received from the orientation detecting means, so that the workpiece is ground to a desired shape, characterised in that the machine also comprises correcting means operable, in response to the operation of the moving means, to cause the output of the orientation detecting means to be altered to compensate, at least substantially, for angular alterations in the point of contact between the workpiece and the grinding wheel caused by the arcuate movement of the workpiece support.

In a grinding machine in accordance with the invention, the aforementioned discrepancy is taken into account in the output of orientation detecting means which reaches the control means so that the control means can operate in a simple manner.

In a machine in accordance with the invention, the correcting means may be operable to move the orientation detecting means, or a portion thereof, to alter its output. For example, where the orientation detecting means is a rotary device, such as an encoder, the correcting means may be operable to turn a portion of the device relative to the remainder thereof.

The machine, preferably, also comprises position detecting means operable to detect the position of the workpiece support relative to the grinding-wheel. The position detecting means provides feedback to the control means.

In a machine in accordance with the invention, the moving means may comprise a motor which is operable to turn a cam which engages a roller mounted on an arm which carries the workpiece support and is pivotal about said axis of the machine, the cam having a peripheral shape which engages the roller, said shape being selected so that there is a linear relationship between angular movements of the cam and movements of the workpiece support towards or away from the grinding wheel.

There now follows a detailed description, to be read with reference to the accompanying drawings, of a grinding machine which is illustrative of the invention.

Figure 1:
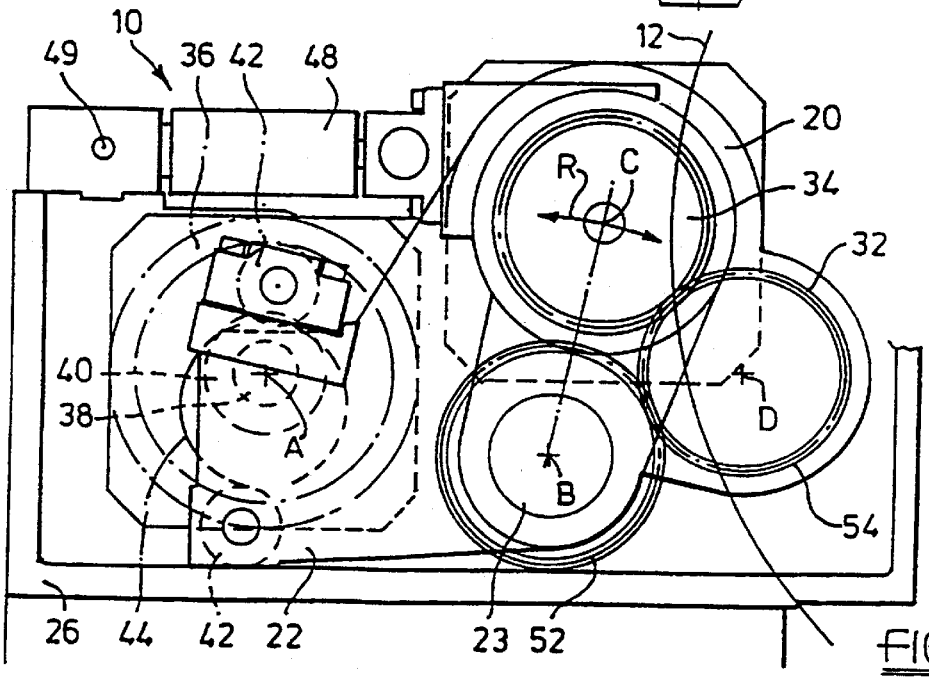

In the drawings:

FIG. 1 is a side elevational view of a portion of the illustrative grinding machine; and FIG. 2 is a view formed by opening out a section line passing through four axes of the machine A, B, C and D, these axes also being shown.

The illustrative grinding machine 10 comprises a grinding wheel 12 which is mounted for rotation about a central axis (not shown) thereof. This axis is on a fixed support on which is also mounted a motor (not shown) which provides rotating means operable to rotate the wheel 12 about the central axis thereof at a constant speed. The grinding wheel 12 (only a portion of the edge of which is indicated in FIG. 1) has an abrasive circumferential edge which is arranged to remove material from a workpiece when the rotating wheel 12 is applied thereto. The grinding wheel 12, its support and its motor are of conventional construction.

The machine 10 also comprises a workpiece support 14 arranged to support a workpiece to be ground by being brought into contact with the edge of the wheel 12. In this case, the workpiece is a cast camshaft having cams projecting therefrom and the machine 10 is set up to grind the circumferential surfaces of the cams to their final shapes. The support 14 carries a driver 16 which drives one end of the workpiece. Although not shown in the drawings, the machine 10 also comprises a further support which supports the other end of the workpiece. The support 14 is mounted on a spindle 17 which is mounted on bearings 18 for rotation about an axis C which extends parallel to the central axis of the wheel 12. Thus, the support 14 is arranged to support the workpiece so that it can be rotated about an axis C of the support 14. Said further support is also rotatable about the axis C. The machine 10 also comprises a motor 20 which provides turning means operable to turn the support 14, and hence a workpiece on the support 14, about the axis C to present different parts of the surface of the workpiece to the grinding wheel 12. Specifically, an output shaft 21 of the motor 20 drives the spindle 17 which in turn drives the support 14.

The bearings 18 and the motor 20 are mounted on an arm 22 of the machine 10. The arm 22 is pivotally mounted on an axis B of the machine 10 by being fixed to a shaft 23. The shaft 23 is mounted on bearings 24 mounted on a fixed frame 26 of the machine 10 for pivoting movement about the axis B. The aforementioned further support for the workpiece is mounted on an arm (not shown) which is also fixed to the shaft 23 for pivotal movement about the axis B so that the opposite ends of the workpiece move together.

The arm 22 also carries orientation detecting means of the machine 10 which is operable to detect the orientation of the workpiece about the axis C of the support 14. The orientation detecting means is provided by an angular encoder 28. The encoder 28 has an input shaft 30 on which is mounted a gear 32 which has 100 teeth around its circumference. The gear 32 is meshed with a gear 34 which is mounted on the support 14 for rotation therewith about the axis C. The gear 34 also has 100 teeth around its circumference so that there is a one-to-one relationship between rotation of the gear 34 and rotation of the gear 32. The encoder 28, for reasons explained hereinafter, is mounted on bearings 29 on the arm 22 to turn about an axis D which is parallel to the axis C. The centre of the gear 32 is on the axis D. The encoder 28 produces an output of electrical pulses, the number of pulses being dependant on the amount by which the gear 32 turns relative to the encoder 28.

The machine 10 also comprises moving means operable to bring about relative movement between the workpiece support 14 and the grinding wheel 12 in order to determine the amount of material removed from the workpiece by the wheel 12. The moving means operates by moving the arm 22 arcuately about the axis B, the extent of this movement being indicated by the arc R in FIG. 1. The moving means comprises a motor 36 mounted on the frame 26. The motor 36 has an output shaft 38 which turns about an axis A which is parallel to the axes B and C. The shaft 38 carries a cam 40 which is mounted for turning movement about the axis A on bearings 41 mounted on the frame 26. The cam 40 is positioned between two rollers 42 which are mounted on the arm 22. The rollers 42 are arranged to engage an outer peripheral surface 44 of the cam 40 at points which engage the cam on opposite sides thereof. Operation of the motor 36 causes the cam 40 to turn about the axis A so that the rollers 42 are moved by the surface 44. The movement of the rollers 42 causes the arm 22 to pivot about the axis B thereby moving the axis C of the workpiece support 14 along the arc R. An encoder 46 associated with the motor 36 provides position detecting means of the machine 10 operable to detect the orientation of the cam 40 and hence of the workpiece support 14 relative to the wheel 12, since movement along the arc R moves the workpiece support 14 towards or away from the central axis of the wheel 12. The movement of the arm 22 is damped by a hydraulic damper 48 which acts between the arm 22 and the frame 26 to which it is pivoted at 49.

The shape of the surface 44 of the cam 40 is arranged so that, throughout the range of movement, a unit angular turn of the cam 40 results in a unit movement of the support 14 towards or away from the central axis of the wheel 12, ie there is a linear relationship between the operation of the motor 36 and the resulting movement of the support 14. This linear relationship is established to simplify operation of control means of the machine 10.

The control means of the machine 10 is provided by a programmable electronic controller (not shown) operable to control the operations of the motors 20 and 36 in accordance with signals received from the encoders 28 and 46. The control of the motors 20 and 36 is to ensure that the workpiece is ground to the desired shape. Thus, as the workpiece is rotated by operation of the motor 20, its orientation about the axis C is signalled to the control means by the encoder 28. In response to the signals from the encoder 28, the control means determines the appropriate orientation of the cam 40 for the portion of the workpiece's surface which is engaged by the wheel 12 and causes the motor 36 to operate to achieve that orientation. The encoder 46 provides feedback that the correct orientation of the cam 40 has been achieved.

As the workpiece support 14 is moved arcuately, the effect of this movement alters the point of contact between the workpiece and the wheel 12 from what it would be were the support 14 moved linearly towards and away from the central axis of the wheel 12. For this reason, the machine 10 also comprises correcting means operable, in response to operation of the motor 36, to alter the output of the encoder 28 so that said output is altered to compensate, at least substantially, for angular alterations in the point of contact between the workpiece and the wheel 12. In other words, the correcting means alters the output of the encoder 28 so that the true orientation of the point of contact is signalled to the control means. Without the correcting means, the signals would be due only to the operation of the motor 20 and for most of the arc R could not represent the true orientation of the point of contact due to the non-linear nature of the movement of the support 14.

The correcting means comprises two gears 52 and 54. The gear 52 is mounted on the frame 26 and its centre is on the axis B about which the arm 22 pivots. The gear 52 is fixed against rotation and has 110 teeth around its circumference. The gear 54 has 98 teeth around its circumference and is meshed with the gear 52. It should be noted that the gears 52 and 54 do not appear to be meshed in FIG. 2, because of the opened-out section but are, in fact, meshed. The gear 54 has its centre on the aforementioned axis D about which the encoder 28 can turn and is fixed to the encoder 28 to turn therewith in the bearings 29. The gear 54 is not fixed to the shaft 30 of the encoder 28 but to the encoder 28 itself.

In the operation of the motor 36, the arm 22 pivots about the axis B so that the axes C and D are moved arcuately about the axis B. The arcuate movement of the axis C moves the workpiece as described above. The arcuate movement of the axis D causes the gear 54 to move around a portion of the circumference of the gear 52 so that the gear 54 is turned about the axis D and turns the encoder 28 about that axis. The turning of the encoder 28 does not turn the shaft 30 which is held against rotation with the encoder 28 by the meshing between the gears 32 and 34. Thus, the correcting means comprises a fixed gear 52 mounted with its centre on the axis B, and a turnable gear 54 mounted to be moved arcuately about said axis B by the operation of the motor 36. The turnable gear 54 is caused to turn by being moved arcuately as aforesaid, due to being meshed with the gear 52, and is fixed to the encoder 28. The turning of the encoder 28 about the axis D adds or subtracts from the number of pulses which the encoder 28 sends to the control means so that the output of the encoder 28 is altered to compensate for the angular alterations in the point of contact. The ratio of 98 to

110 between the gears 54 and 52 is selected to suit the angle moved by the arm 22 plus the changing angle between axis C and the centre of wheel 12.

What is claimed is:

1. A grinding machine comprising a grinding wheel having an abrasive circumferential surface arranged to remove material from a workpiece when the grinding wheel is applied thereto, rotating means operable to rotate the grinding wheel about a central axis thereof, a workpiece support arranged to support a workpiece so that the workpiece can turn about an axis of the support, turning means operable to turn a workpiece on said support about the axis of the support to present different parts of the surface of the workpiece to the grinding wheel, orientation detecting means operable to detect the orientation of the workpiece on the support, moving means operable to bring about relative movement between the workpiece support and the grinding wheel, the moving means being arranged to move the workpiece support arcuately about an axis of the machine to bring about said relative movement, and control means operable to control the operations of the turning means and of the moving means, in accordance with signals received from the orientation detecting means, so that the workpiece is ground to a desired shape, wherein the machine also comprises correcting means operable, in response to the operation of the moving means, to cause the output of the orientation detecting means to be altered to compensate, at least substantially, for angular alterations in the point of contact between the workpiece and the grinding wheel caused by the arcuate movement of the workpiece support.

2. A machine according to claim 1, wherein the correcting means is operable to move the orientation detecting means to alter its output.

3. A machine according to claim 2, wherein the orientation detecting means comprises an encoder and the correcting means is operable to turn the encoder relative to its input shaft.

4. A machine according to claim 2, wherein the correcting means comprises a fixed gear mounted with its center on the axis about which the workpiece support moves, and a turnable gear mounted to be moved arcuately about said axis by the operation of the moving means, the turnable gear being meshed with the fixed gear so that it is caused to turn by being moved arcuately as aforesaid, the turnable gear being drivingly connected to the orientation detecting means.

5. A machine according to claim 1, wherein the machine also comprises position detecting means operable to detect the position of the workpiece support relative to the grinding wheel.

6. A machine according to claim 1, wherein the moving means comprises a motor which is operable to turn a cam which engages a roller mounted to an arm which carries the workpiece support and is pivotal about said axis of the machine, the cam having a peripheral shape which engages the roller, said shape being selected so that there is a linear relationship between angular movements of the cam and movements of the workpiece support towards or away from the grinding wheel.

* * * * *